United States Patent [19]

Izzo

[11] Patent Number: 4,803,511

[45] Date of Patent: Feb. 7, 1989

[54] SLIDING PLATE ASSEMBLY

[75] Inventor: Peter G. Izzo, Rochester, N.Y.

[73] Assignee: Eastman Kodak Company, Rochester, N.Y.

[21] Appl. No.: 195,481

[22] Filed: May 10, 1988

Related U.S. Application Data

[63] Continuation of Ser. No. 93,847, Sep. 8, 1987, abandoned.

[51] Int. Cl.[4] ..... G03G 15/00

[52] U.S. Cl. ..... 355/3 R; 355/3 BE

[58] Field of Search ..... 355/3 BE, 3 DR, 3 R, 355/16

[56] References Cited

U.S. PATENT DOCUMENTS

| | | | |
|---|---|---|---|
| 4,386,841 | 6/1983 | Wakao | 355/3 DR |
| 4,563,077 | 1/1986 | Komada | 355/3 BE |
| 4,585,324 | 4/1986 | Koyama | 355/3 DR |
| 4,616,920 | 10/1986 | Itoigawa et al. | 355/38 E |
| 4,634,264 | 1/1987 | Takahashi | 355/16 |
| 4,668,072 | 5/1987 | Yasuda | 355/3 R |
| 4,702,587 | 10/1987 | Miyoshi | 355/3 DR |

*Primary Examiner*—R. L. Moses

*Attorney, Agent, or Firm*—Lawrence P. Kessler

[57] ABSTRACT

An improved electrostatographic apparatus including a housing having a lower portion containing electrostatographic process stations and an upper portion connected thereto containing a dielectric member mounted for movement about a closed loop path. The upper housing portion is movable relative to the lower housing portion to a first position where the dielectric member is in operative relation to such electrostatographic process stations and a second position wherein the dielectric member is remote from such electrostatographic process stations to enable ready access to such process stations. The dielectric member is mounted in the upper housing portion for movement with the upper housing portion or movement relative thereto to a position intermediate the upper and lower housing portions when the upper portion is in its second position. The improvement comprises a sliding plate assembly, connected to the dielectric member mount and the lower housing portion, for accurately locating the dielectric member in its intermediate position. Further, such assembly enables movement of the upper housing portion to its operative position from its remote position when the dielectric member is in its position to move with the upper housing portion, and inhibits movement of the upper housing portion from its remote position to its operative position when the dielectric member is in its intermediate position.

5 Claims, 8 Drawing Sheets

SLIDING PLATE ASSEMBLY

This is a continuation of application Ser. No. 093,847, filed Sept. 8, 1987, now abandoned.

RELATED APPLICATION

This application is related to U.S. patent applications Ser. No. 081,765, entitled MULTI-MODE ELECTROPHOTOGRAPHIC REPRODUCTION APPARATUS, filed on Aug. 5, 1987, in the name of William H. Bruce, Jr, and Ser. No. 081,764, entitled PHOTOCONDUCTIVE MEMBER MOUNTING MECHANISM FOR AN ELECTROPHOTOGRAPHIC REPRODUCTION APPARATUS filed Aug. 5, 1987 in the name of Kenin et al.

BACKGROUND OF THE INVENTION

This invention is directed in general to electrostatographic reproduction apparatus, and more particularly to a sliding plate assembly for locating a dielectric member of an electrostatographic apparatus for removal and replacement, and inhibiting the movement of a portion of the apparatus to prevent damage to the dielectric member.

Electrostatographic reproduction apparatus, and particularly electrophotographic apparatus, typically reproduce information by exposing a uniformly charged dielectric member to an image of information. For example, a light image of information to be reproduced modifies the uniform charge on the photoconductive surface of a dielectric member so as to form a charge pattern, or latent image, on the surface corresponding in an image-wise configuration to the information to be reproduced. Pigmented marking particles, exhibiting a charge of opposite polarity to that of the latent image charge pattern, are brought into contact with the photoconductive surface and adhere to the areas of the surface where the charge pattern exists to develop the latent image and form a transferable image. Thereafter, the transferable image is transferred to a receiver member and permanently fixed to such member by heat and/or pressure to form the desired reproduction.

The dielectric member, in the form of a continuous belt or drum for example, must be accurately locateable relative to the electrostatographic process stations, and at the same time, must be accessible for ready removal and replacement. Further, the electrostatographic process stations must be readily accessible for station adjustment, replacement, or clearing of receiver member jams.

U.S. Pat. No. 4,386,841 (issued June 7, 1983 in the name of Wakao et al) shows an electrophotographic reproduction apparatus where the photoconductive surface is associated with a support assembly such that the electrostatographic process stations are accessible and the surface can be removed and replaced. However, photoconductive surface removal and replacement requires removal of the ensire support assembly. As such, accurate registration of the photoconductive surface on replacement is dependent upon how accurately the support assembly, with the new surface, can be registered in the apparatus. This can prove difficult, and moreover requires complex structure to connect the photoconductive surface drive to the support assembly. Moreover, the portion of the apparatus containing the movable photoconductive surface support assembly can be closed with the support assembly in its position for replacing the photoconductive surface. This may result in damage to the photoconductive surface or the reproduction apparatus itself.

SUMMARY OF THE INVENTION

This invention is directed to an improved electrostatographic apparatus including a housing having a lower portion containing electrostatographic process stations and an upper portion connected thereto containing a dielectric member mounted for movement about a closed loop path. The upper housing portion is movable relative to the lower housing portion to a first position where the dielectric member is in operative relation to such electrostatographic process stations and a second position wherein the dielectric member is remote from such electrostatographic process stations to enable ready access to such process stations. The dielectric member is mounted in the upper housing portion for movement with the upper housing portion or movement relative thereto to a position intermediate the upper and lower housing portions when the upper portion is in its second position. The improvement comprises a sliding plate assembly, connected to the dielectric member mount and the lower housing portion, for accurately locating the dielectric member in its intermediate position. Further, such assembly enables movement of the upper housing portion to its operative position from its remote position when the dielectric member is in its position to move with the upper housing portion, and inhibits movement of the upper housing portion from its remote position to its operative position when the dielectric member is in its intermediate position.

According to a preferred embodiment of this invention, the upper housing portion includes a first frame pivotally connected to the lower housing portion, and a second frame, supporting the dielectric member. The second frame member is coupled to the first frame for movement therewith, or for movement relative to the first frame to locate the dielectric member in the intermediate position. A sliding plate assembly is connected between the second frame and the lower housing portion. The dimension of the sliding plate assembly and the location of the connection thereof to the second frame and the lower housing portion enables the second frame (and thus the dielectric member) to move with the first frame and relative to the first frame to be accurately located in its intermediate position. However, by such arrangement, the sliding plate assembly inhibits the first frame (and thus the upper housing portion) from being moved to its operative position unless the second frame is in its position to move with the first frame. Accordingly, with the sliding plate assembly according to this invention, the dielectric member is accurately locateable for removal and replacement, and damage to the dielectric member, and the electrostatographic apparatus in general, due to premature movement of the upper housing portion is prevented.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
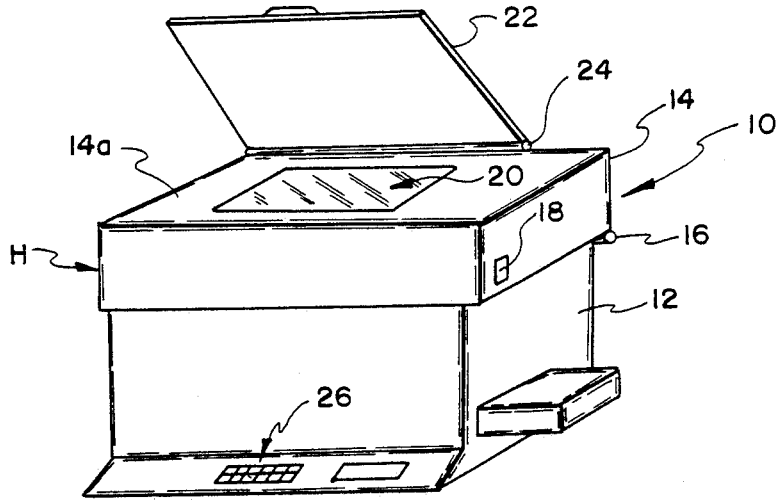
FIG. 1 is a view, in perspective, of an exemplary electrostatographic reproduction apparatus in which this invention is utilized.
Figure 2:
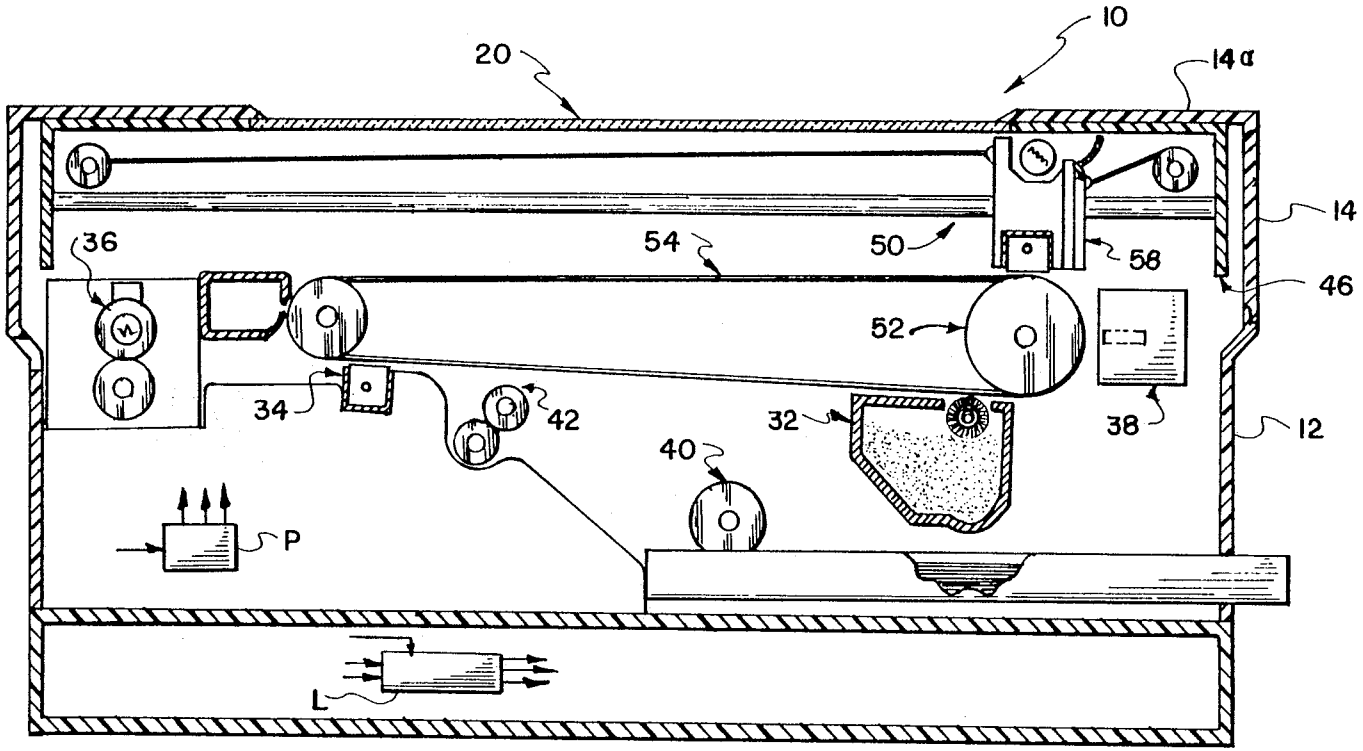
FIG. 2 is a front elevational view of the electrostatographic reproduction apparatus of FIG. 1 on an enlarged scale, in cross-section, and with portions broken away or removed to facilitate viewing.
Figure 3:
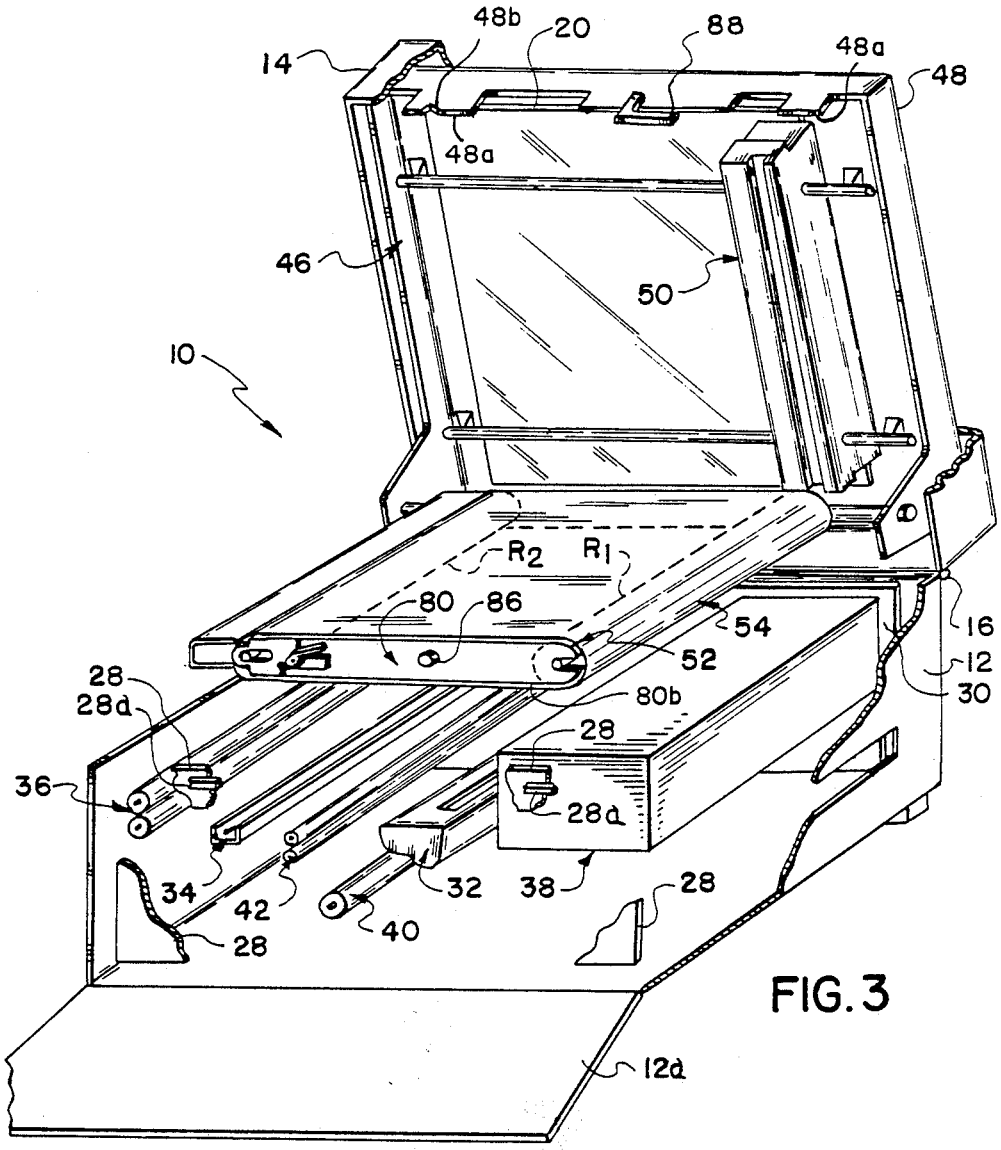
FIG. 3 is a view, in perspective, of the electrostatographic reproduction apparatus with portions in a position to enable ready access to the apparatus interior.
Figure 4:
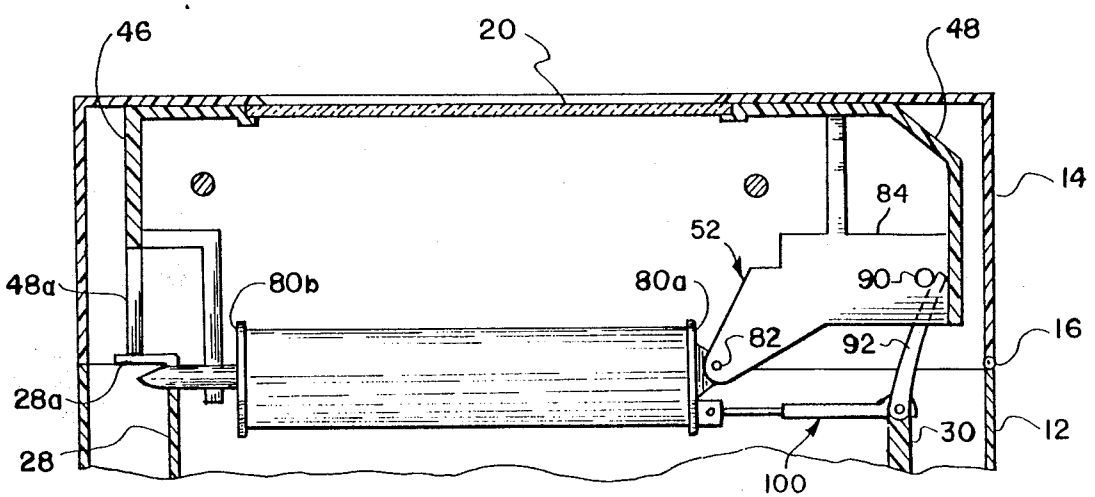
FIG. 4 is an end elevational view of the dielectric member and its mounting mechanism according to this invention, in its operative position, partly in cross-section and with portions broken away or removed to facilitate viewing.
Figure 5:
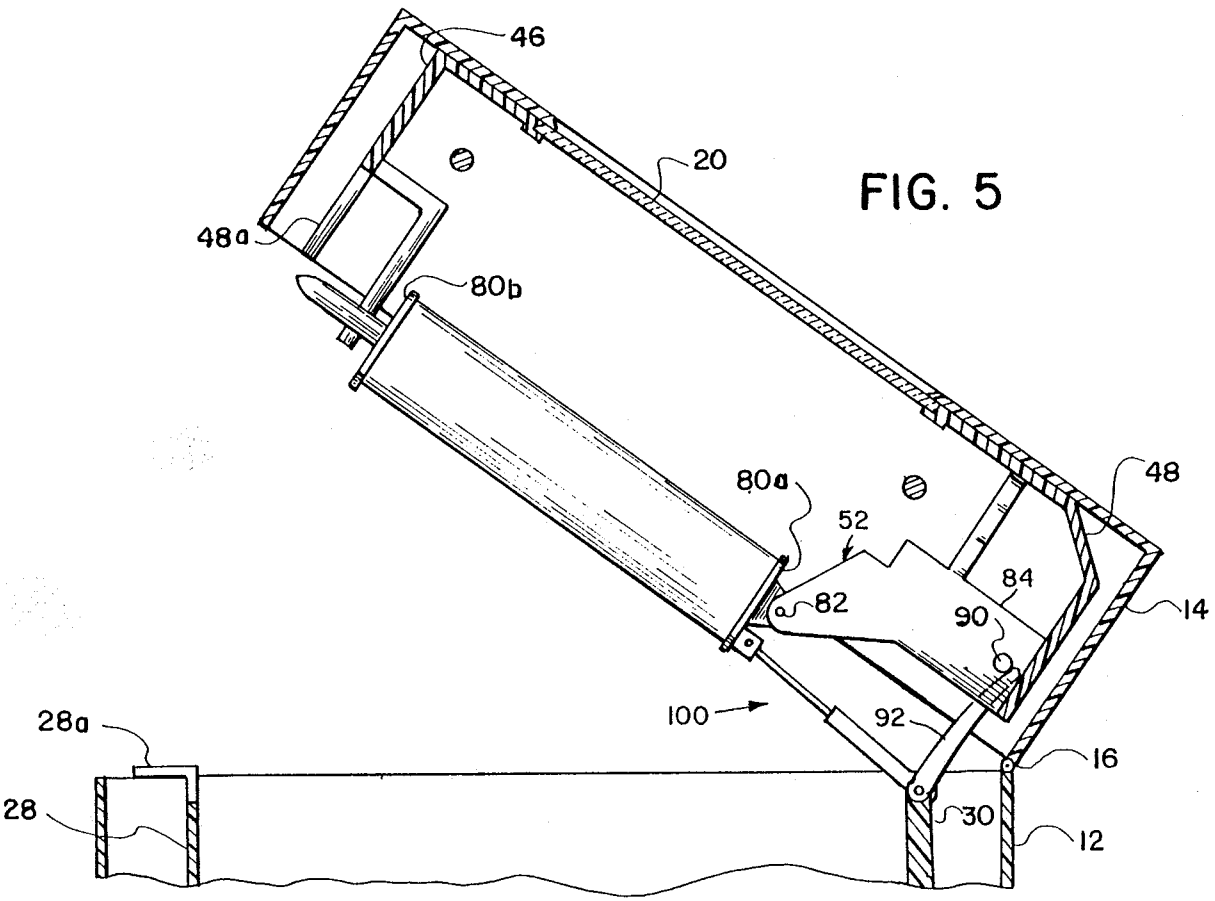
FIG. 5 is an end elevational view of the dielectric member and its mounting mechanism, similar to FIG. 4, in its position to permit access to the interior of the reproduction apparatus.
Figure 6:
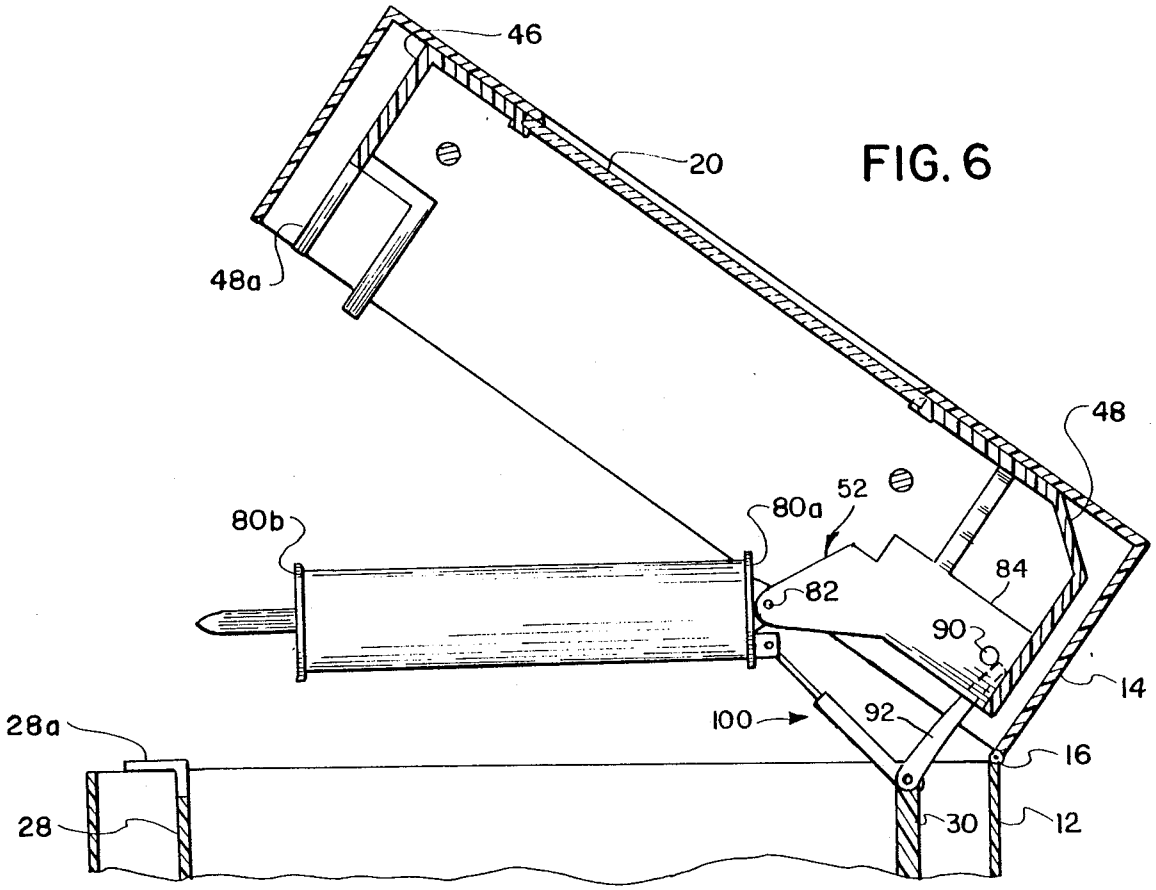
FIG. 6 is an end elevational view of the dielectric member and its mounting mechanism, similar to FIG. 4, in its position to enable the dielectric member to be readily removed and replaced.
Figure 7:
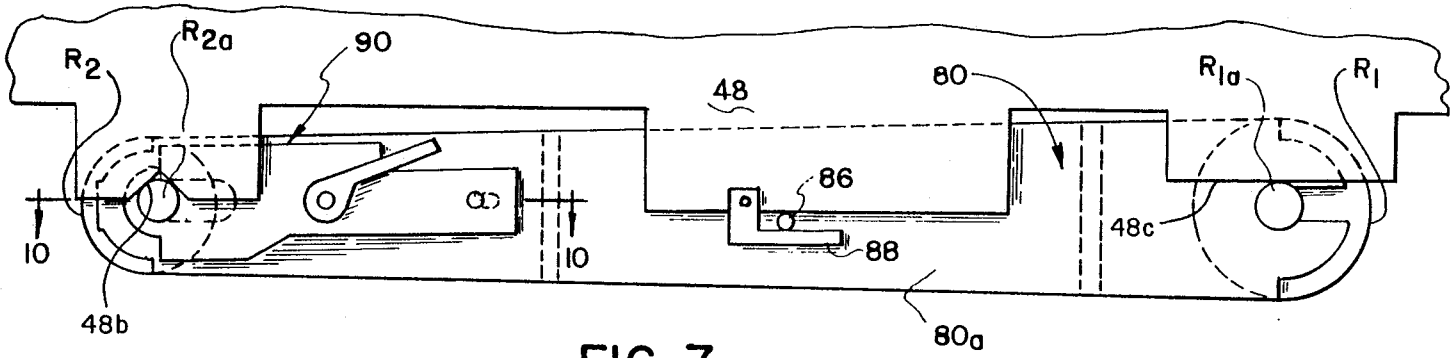
FIG. 7 is a front elevational view of the dielectric member including a tensioning mechanism, partly in cross-section and with portions broken away or removed to facilitate viewing.
Figure 8:
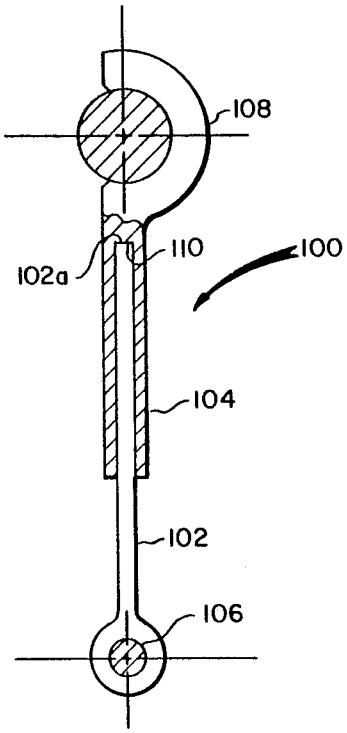
FIG. 8 is a side elevational view, in cross-section and on an enlarged scale, of the sliding plate assembly, according to this invention.
Figure 10:
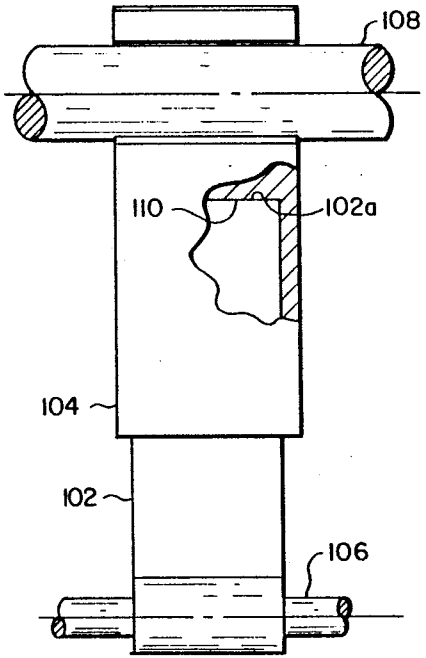
FIG. 10 is a front elevational view of the sliding plate assembly, of FIG. 8, in its movement inhibiting position.
Figure 9:
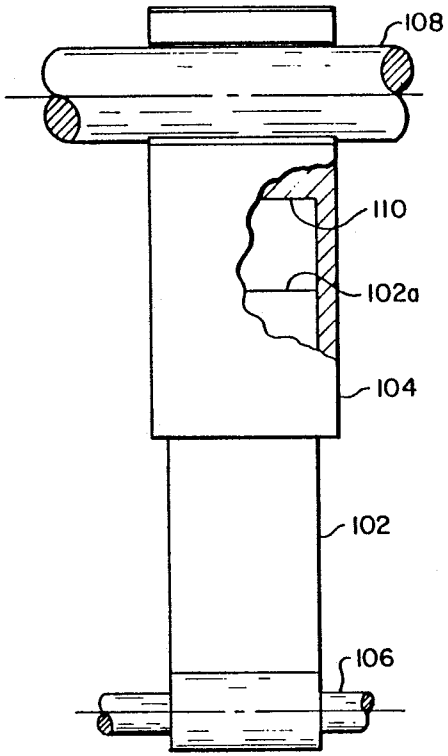
FIG. 9 is a front elevational view of the sliding plate assembly, of FIG. 8, in its movement enabling position.

Referring now to the accompanying drawings, FIGS. 1–3 show a multi-mode electrophotographic reproduction apparatus, designated generally by the numeral 10. Of course, the reproduction apparatus 10 is only exemplary, and this invention is suitable for use with other electrostatographic reproduction apparatus. The reproduction apparatus 10 and its operation, which are fully disclosed in the aforementioned related U.S. patent application Ser. Nos. 081,765 and 081,764, are described herein only in such detail as to permit a full understanding of this invention. Particularly, the apparatus 10 includes a housing H having a lower portion 12 and an upper portion 14 interconnected by a hinge mechanism 16. The upper and lower housing portions 12, 14 are retained in a closed relation by a latch 18, with release of the latch enabling the portions to be opened (see FIG. 3) to permit access to the interior of the apparatus 10. The upper portion 14 has a stationary transparent platen 20, formed in the top surface 14*a* thereof, for supporting a document to be optically reproduced. An opaque cover member 22 is connected to the upper portion 14 by an articulating hinge mechanism 24. The member 22 is thus capable of covering a document placed on the platen 20 for optical reproduction, or articulated to hold a book (or other three dimensional object to be optically reproduced) on the platen. A front panel 12*a* of the lower portion 12 of the housing H is opened to provide access to the interior of the apparatus 10.

The lower portion 12 of the housing H has a control panel 26, located at the bottom front thereof beneath the panel 12*a*. The control panel 26 is operatively coupled to a logic and control unit L for the apparatus 10 and enables an operator to select operating parameters for the apparatus and monitor its functions. The logic and control unit L includes, for example, a microprocessor receiving operator input signals and timing signals. Based on such signals and a program from the microprocessor, the unit L produces signals to control the operation of the apparatus 10 for carrying out the reproduction process. The production of the program for a number of commercially available microprocessors such as an INTEL Model 8080 or Model 8085 microprocessor (which along with others are suitable for use with this invention) is a conventional skill well understood in the art. The particular details of any such program would, of course, depend on the architecture of the designated microprocessor.

A pair of oppositely disposed machine plates 28, 30, are located within the lower portion 12 of the housing H. The plates serve to locate, and relatively position, various elements utilized in the electrostatographic process for image reproduction. Such elements include, for example, a magnetic brush developer station 32, a transfer charger 34, and a heat/pressure fuser assembly 36. Additionally, the plates support a mechanism 38 for reproducing electronically generated information, a receiver member feed mechanism 40, and receiver member registration mechanism 42. Further, a drive assembly is supported by the rear plate 30. The drive assembly includes a motor, gear train and a plurality of clutches interrelated a well known manner for effecting operation of various components and elements of the apparatus 10. Of course, other drive assemblies, such as belts and pulleys, are suitable for use with this invention.

The upper portion 14 of the housing H contains a supporting member 46 in the form of a rigid frame 48. The frame serves to locate and relatively position an optical exposure assembly 50 and an assembly 52 for supporting a photoconductive belt 54. The photoconductive belt 54 is a composite dielectric member including a typical photoconductive material layer such as shown, for example, in U.S. Pat. No. 3,615,41, issued Oct. 26, 1971 in the name of Light. Of course, other organic or inorganic photoconductive materials are suitable for use with this invention.

The assembly 52 for supporting the photoconductive belt 54 is best shown in FIGS. 4–7. Such assembly comprises a pair of rollers $R_1$, $R_2$ supported by a torque frame 80. The torque frame, which maintans the rollers $R_1$, $R_2$ in substantial relative alignment, is in turn supported at its rearwardly facing end 80*a* on a pivot shaft 82 carried by a portion 84 of the rigid frame 48 of the supporting member 46. The forwardly facing end 80*b* of the torque frame has a pin 86 extending outwardly therefrom. The pin 86 is adapted to be engaged by a latching mechanism 88 carried by the rigid frame 48. Such engagement retains the assembly 52 in the supporting member 46.

In order to maintain accurate positional relation of the assembly 52 to the platen 20 (see FIG. 4), and thus relative to the optical exposure assembly 50, the rigid frame 48 has locating features 48*b*, 48*c*. Feature 48*b* includes a V-shaped notch, while the feature 48*c* includes a flatted land (see FIG. 7). The V-shaped notch receives shaft $R_{2a}$, and the shaft $R_{1a}$ bears against the land when the assembly 52 is retained in the supporting member 46 by the latch mechanism 88 engaging the pin 86. Such arrangement provides the desired accurate positional relaative without inducing an over constrained condition on the system; i.e., allows for structural differences due to manufacturing tolerances or environmentally induced effects thereon. The rigid frame 48 also has a pair of datums 48*a* which respectively engage a pair of datums 28*a* extending from the machine plate 28 when the upper portion 14 is in its closed position. The cooperative engagement of the datums assures accurate location of the upper portion with the electrostatographic process stations in the lower portion 12.

A rod 90 is connected to the portion 84 of the rigid frame 48 and is engaged by a torsion bar 92 coupled to the machine plate 30. The torsion bar 92 applies a force to the rod 90 which acts to counter balance the weight of the upper portion 14 of the housing H when such upper portion is pivoted about the hinge 16 to an open position (see FIG. 5) to provide access to the interior of the apparatus 10. When the portion 14 is in its open position, the latching mechanism 88 may be released to enable the torque frame 80 to pivot about the shaft 82 to an intermediate position (see FIG. 6) where removal and replacement of the photoconductive belt 54 is facilitated.

When the torque frame 80 is moved to its intermediate position, it is desirable to accurately locate such frame in a substantially horizontal position so that the photoconductive belt can be replaced without touching any portion of the reproduction apparatus 10 in order to prevent damage to the new belt. Further, movement of the frame 48 should be inhibited when the frame 80 is in its intermediate position to prevent damage to the belt, its support structure or any other portion of the reproduction apparatus. Accordingly, this invention provides a sliding plate assembly 100 to accurately locate the torque frame 80 when in the intermediate position, and inhibit movement of the frame 48 from its remote position unless the torque frame is in its position to move with the frame 48.

The sliding plate assembly 100, as best shown in FIGS. 4–6 and 8–10, includes an elongated plate 102 and a receptacle 104 for slidably receiving such plate. The plate 102 is pivotally mounted on a pin 106 connected to the rearwardly facing end 80*a* of the torque frame 80; and the receptacle 104 is pivotally mounted on a pin 108 connected to the machine plate 30. The pins 106 and 108 are oriented such that their respective longitudinal axes are parallel to the longitudinal axis of the hinge 16 between the upper housing portion 14 and the lower housing portion 12. In this manner, as the upper housing portion 14 is moved about the hinge 16 relative to the lower housing portion 12, the plate 102 slides in the receptacle 104 as the distance between the pins 106 and 108 changes.

The receptacle 104 has a stop surface 110 which is engageable by the end 102*a* of the plate 102 when the plate is fully inserted into the receptacle. The depth of the receptacle to the stop surface 110, and length of the plate 102 are selected such that when the torque frame 80 is released from the frame 48 and moved to the intermediate position the plate end 102*a* engages the stop surface 110. This accurately locates the torque frame, and thus the photoconductive belt, in a substantially horizontal orientation. Further, due to the relationship of the axes of the pins 106 and 108 and the hinge 16, engagement of the plate end with the stop surface inhibits movement of the frame 48 from its remote position when the torque frame 80 is in its intermediate position. That is, the torque frame must be first returned to its latched position for movement with the frame 48 before the frame 48 is movable from its remote position (see FIG. 6) to its operative position (see FIG. 4). This prevents damage to the dielectric member, and the electrostatographic apparatus in general, due to premature movement of the upper housing portion.

With the described electrostatographic reproduction apparatus, the sliding plate assembly, according to this invention, enables the dielectric member of the reproduction apparatus to be accurately locateable for removal and replacement. Further, such assembly inhibits movement of the upper housing portion from its remote position to its operative position when the dielectric member is in its intermediate position to prevent damage to the dielectric member, and the electrostatographic apparatus in general, due to premature movement of the upper housing portion.

The invention has been described in detail with particular reference to a preferred embodiment thereof, but it will be understood that variations and modifications can be effected within the spirit and scope of the invention.

I claim:

1. In an improved electrostatographic apparatus including a housing having a lower portion containing electrostatographic process stations and an upper portion connected thereto containing a support assembly for a dielectric member mounted for movement about a closed loop path, and wherein said upper housing portion is movable relative to said lower housing portion to a first position whereby said dielectric member is in operative relation to such electrostatographic process statons and a second position wherein said dielectric member is remote from said electrostatographic process stations to enable ready access to such process stations, and wherein said dielectric member support assembly is movable relative to said upper housing portion to a position intermediate said upper and lower housing portions when said upper portion is in its second position, said improvement comprising:

means for inhibiting movement of said upper housing portion from its second position to its first position when said dielectric member support assembly is in its intermediate position, whereby damage to said dielectric member by movement of said upper housing portion is prevented.

2. The invention of claim 1 wherein said upper housing portion includes a first frame, and wherein said support assembly includes a second frame supporting at least a pair of rollers about which said dielectric member is entrained, and means for coupling said second frame to said first frame for movement therewith, or movement relative to said first frame to locate said rollers in said intermediate position; and wherein said enabling and inhibiting means includes a sliding plate assembly coupled to said second frame and said lower housing portion.

3. The invention of claim 2 wherein said sliding plate assembly includes a plate and a member defining a receptacle adapted to slidably receive said plate.

4. The invention of claim 3 wherein said plate is pivotally mounted on a first pin connected to said second frame, and said receptacle is pivotally mounted on a pin connected to said lower housing portion, the longitudinal axes of said first and second pins being parallel to the longitudinal axis about which said upper housing portion is movable between its first and second positions.

5. The invention of claim 4 wherein said receptacle member includes a stop surface engageable by an end of said plate when said second frame is in said intermediate position to accurately locate said dielectric member in such intermediate position, and inhibit movement of said first frame from said second position.

* * * * *